US012460369B1

(12) United States Patent
Priest

(10) Patent No.: US 12,460,369 B1
(45) Date of Patent: Nov. 4, 2025

(54) HEIGHT ADJUSTABLE MANHOLE COVER

(71) Applicant: Douglas Priest, Ocala, FL (US)

(72) Inventor: Douglas Priest, Ocala, FL (US)

( * ) Notice: Subject to any disclaimer, the term of this patent is extended or adjusted under 35 U.S.C. 154(b) by 586 days.

(21) Appl. No.: 17/969,029

(22) Filed: Oct. 19, 2022

(51) Int. Cl.
*E02D 29/14* (2006.01)
*E02D 29/12* (2006.01)

(52) U.S. Cl.
CPC ..... *E02D 29/1409* (2013.01); *E02D 29/121* (2013.01)

(58) Field of Classification Search
CPC ..... E02D 29/121; E02D 29/1409
USPC ..... 404/26; 52/19, 20
See application file for complete search history.

(56) References Cited

U.S. PATENT DOCUMENTS 1,408,982 A * 3/1922 Calhoun ..... E02D 29/1463 404/26
4,075,796 A * 2/1978 Cuozzo ..... E02D 29/1409 404/26
4,883,590 A * 11/1989 Papp ..... E03F 5/0407 210/232
6,036,401 A * 3/2000 Morina ..... E03B 9/10 404/26
6,311,433 B1 * 11/2001 Zdroik ..... E02D 29/1409 404/26
6,682,258 B2 * 1/2004 McNeely ..... E02D 29/1409 404/26
9,771,702 B2 9/2017 Han
2004/0071508 A1 * 4/2004 Nadasde ..... E02D 29/1409 404/26

FOREIGN PATENT DOCUMENTS

CA 2229380 A1 * 2/1998 ..... E02D 29/14
CA 2270314 A1 * 10/2000 ..... E02D 29/1409

* cited by examiner

*Primary Examiner* — Raymond W Addie
(74) *Attorney, Agent, or Firm* — Sanchelima & Associates, P.A.; Jesus Sanchelima; Christian Sanchelima

(57) ABSTRACT

A height adjustable manhole cover including an outer unit assembly, an inner unit assembly. The inner unit assembly is secure on top of a concrete manhole unit by means of a flange under a driving road surface. The inner unit assembly further includes on top an external threaded area. The outer unit assembly includes an internal threaded area on bottom thereof. The outer unit assembly supports a manhole cover. The outer unit assembly is surrounded by means of a base course under the asphalt. The outer assembly includes cleats formed about the top of the outer assembly. A user would then interact with the cleats to rotate the outer unit assembly to a desired orientation to adjust the height thereof, therefore, the manhole cover can be adjacent to the driving road surface.

9 Claims, 5 Drawing Sheets

HEIGHT ADJUSTABLE MANHOLE COVER

BACKGROUND OF THE INVENTION

1. Field of the Invention

The present invention relates to a height adjustable manhole cover and, more particularly, to a height adjustable manhole cover that includes an easy height adjustment manhole lid comprised of an inner threaded unit and an outer threaded unit.

2. Description of the Related Art

Several designs for manhole covers have been designed in the past. None of them, however, include an inner threaded unit and an outer threaded unit threadably connected therebetween, that permits a rotation to adjust the height of a manhole lid with respect to the driving surface.

Applicant believes that a related reference corresponds to U.S. Pat. No. 4,075,796 issued for adjustable height manhole with locking means. Applicant believes that another related reference corresponds to U.S. Pat. No. 9,771,702 issued for manhole with height/inclination-adjustable manhole cover. None of these references, however, teach of a height adjustable manhole cover comprising of an outer tubular unit with a threaded interior wall, an inner tubular unit with a threaded exterior wall and manhole cover, where in the tubular units are threadably connected and the height adjustment is accomplished by rotating the outer tubular unit.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a manhole lid than can be adjusted in height to provide an even surface with respect to the pavement, thereby preventing the risk of accidents by uneven roads.

It is another object of this invention to provide a plurality of cleats on the sides of the outer threaded unit to permit a rotation thereof, hitting these cleats allows to rotate and adjust the height of the manhole lid with an adjacent road surface height.

It is still another object of the present invention to provide a plurality of grease fittings to provide a means of lubricating the threated area of the assembly to prevent the inner threaded unit and the outer threaded unit become stuck.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
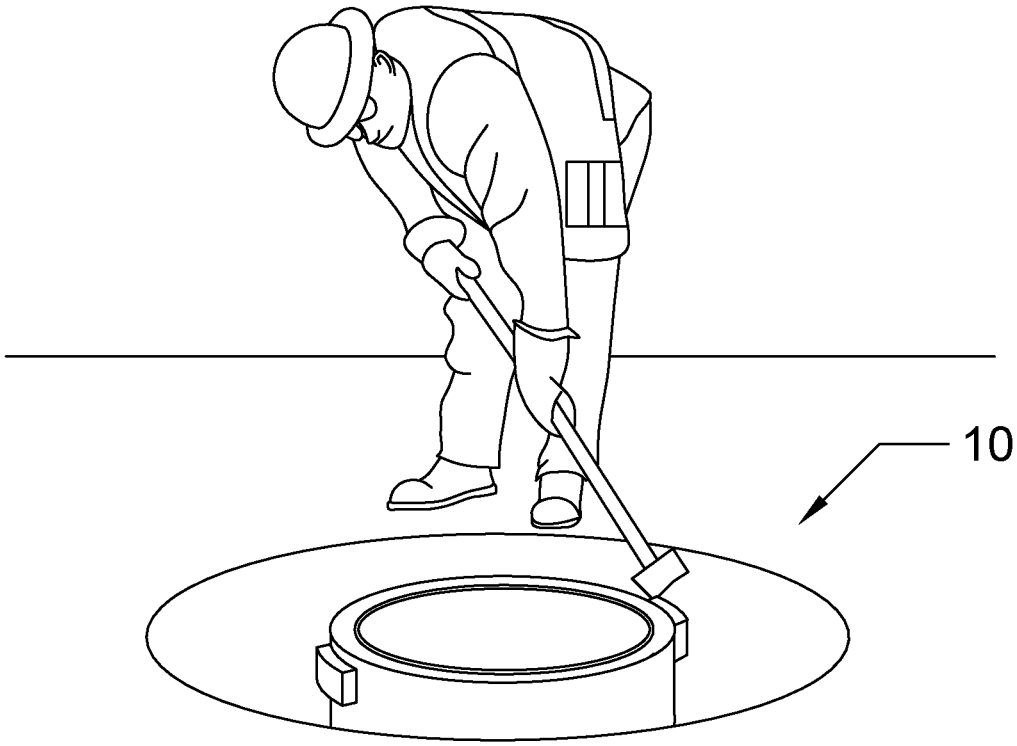
FIG. 1 represents an operational view according to an exemplary embodiment of the present invention 10

Referring now to the drawings, where the present invention is generally referred to with numeral 10, it can be observed that it basically includes manhole cover assembly 20, an outer unit assembly 40 and an inner unit assembly. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
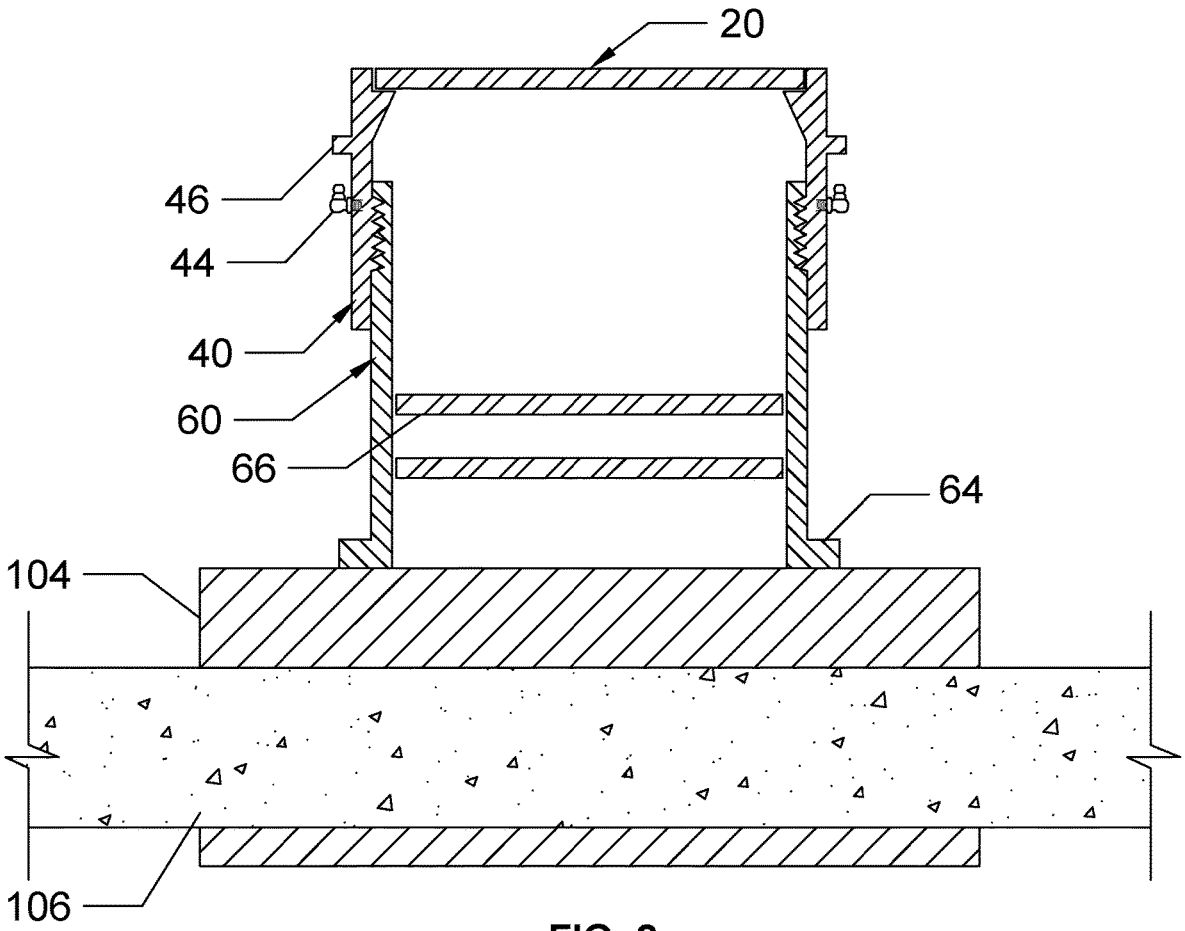
FIG. 2 shows a cross-sectional view of the manhole cover assembly 20, the outer unit assembly 40, and the inner unit assembly 60 in accordance with the exemplary embodiment of the present 10 of the present invention

In an exemplary embodiment of the present invention 10 shown in FIG. 1 represent a manhole system which the functionality is to restrict the entry to a storm drain pipe 106 with the particularity to be adjustable in height. FIG. 2 illustrates the present invention 10 with the manhole cover assembly 20 on top including a lid 22. The lid 22 in a preferred embodiment may have a cylindrical shape. However, in another exemplary embodiment the lid 22 is made of plastic material, iron or any variation thereof as known in the art. A top surface of the lid 22 is located adjacent to a surface of a pavement of a driving road as shown in FIG. 1.

The outer unit assembly includes a female unit 42, a plurality of grease fittings 44 and a plurality of cleats 46. The female unit 42 in a preferred embodiment may have a cylindrical shape, a rim shape or any variation thereof. The female unit 42 may be made of iron, steel, metal alloys, or any other suitable material as known in the art. On a top portion, the female unit 42 has a groove that may be formed wherein a bottom surface of the lid 22 sits. On top of the female unit 42 and perpendicular to the groove a wall may be formed to surround the periphery of the lid 22 as illustrated in FIG. 2. The lid 22 sits by means of its own weight on the groove of the female unit 42 restricting the entry to the manhole. In an internal portion of a bottom of the female unit 42 a thread section may be formed. In an external portion of the female unit 42 there are grease fittings 44 disposed orthogonally with respect to the external surface thereof. The grease fittings 44 may be standard grease fittings, drive grease fittings, pressure relief grease fittings or any variation thereof from the art. The grease fittings 44 may be configured to feed lubricant long across a width of the female unit 42 toward the threaded portion thereof. Nevertheless, in another exemplary embodiment, in a section of the periphery of the female unit 42 between the grease fittings 44 and the top section of the female unit 42 a plurality of cleats 46 are coupled that may be formed in such a geometry that is capable of interacting with a variety of tools allowing it to be hit to rotate the female unit 42 by means of the threaded portion.

Figure 3:
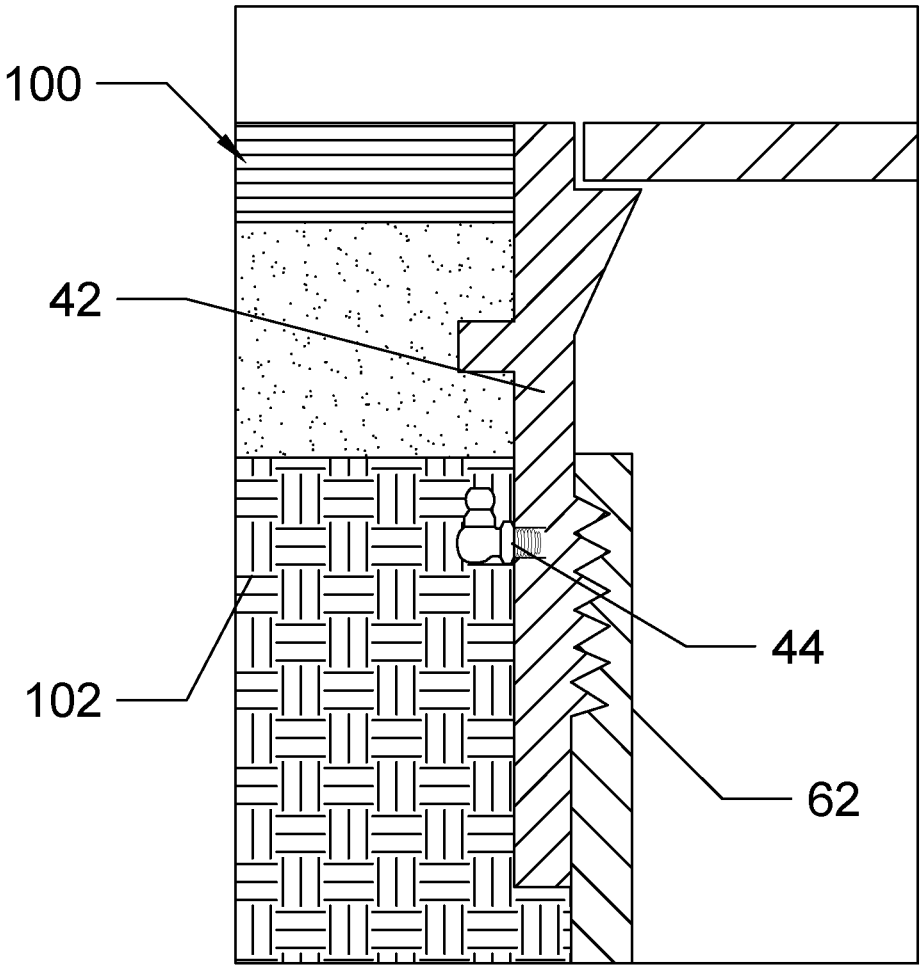
FIG. 3 illustrates a detailed cross-sectional view of the threaded connection between the inner threaded unit 62 and the outer threaded unit 42

The inner unit assembly 60 includes a male unit 62, a flange 64 and a swivel joints 66. The male unit 62 in a preferred embodiment may have a cylindrical shape, rim shape or any other variation thereof. About an external surface of a top portion of the male unit 62 a threaded section may be formed. The male unit 62 is received inside the female unit 42 for the interaction of the threaded portion of both the male unit 62 and the female unit 42, thereby creating a threaded connection therebetween as FIG. 3 illustrates. On a bottom section of the periphery of the male unit 62 a flange 64 is formed. The flange 64 extends pass the periphery of the male unit 62. the flange 64 may be configured to attached the male unit 62 to a concrete manhole unit 104 or any other structure known in prior art. Between the top portion of the male unit 62 and the flange 64, the male unit 62 is divided in a top portion and a bottom portion united by means of a swivel joint 66. The swivel joint 66, in its various embodiments, is configured to forestall structural damages thereof due to operating conditions.

Figure 4A:
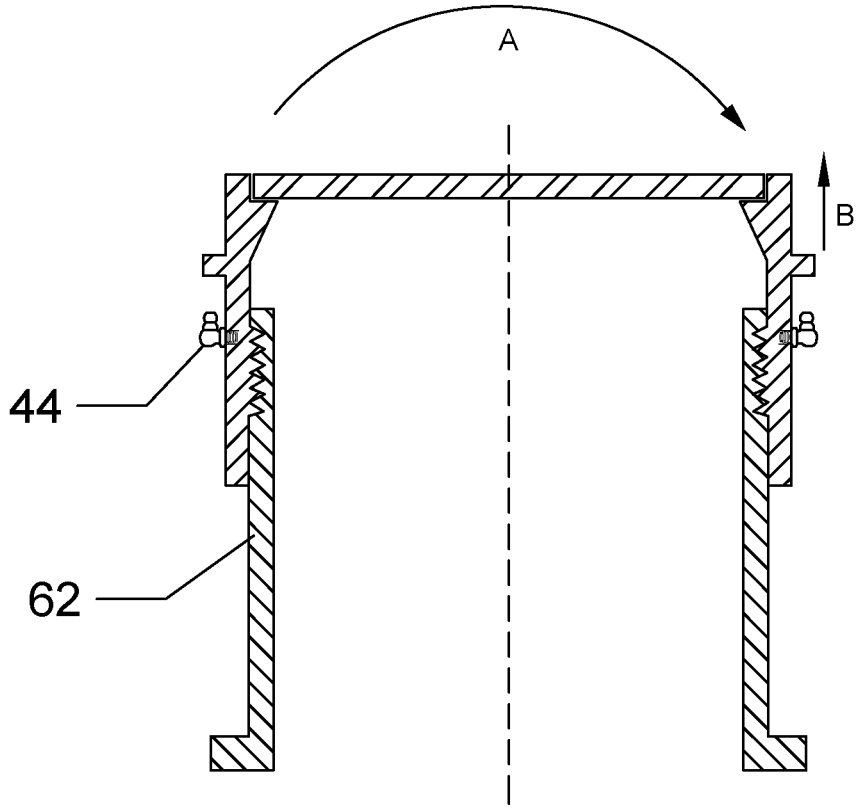
FIG. 4A is a representation of cross-sectional view of the present invention 10 in a base position.
Figure 4B:
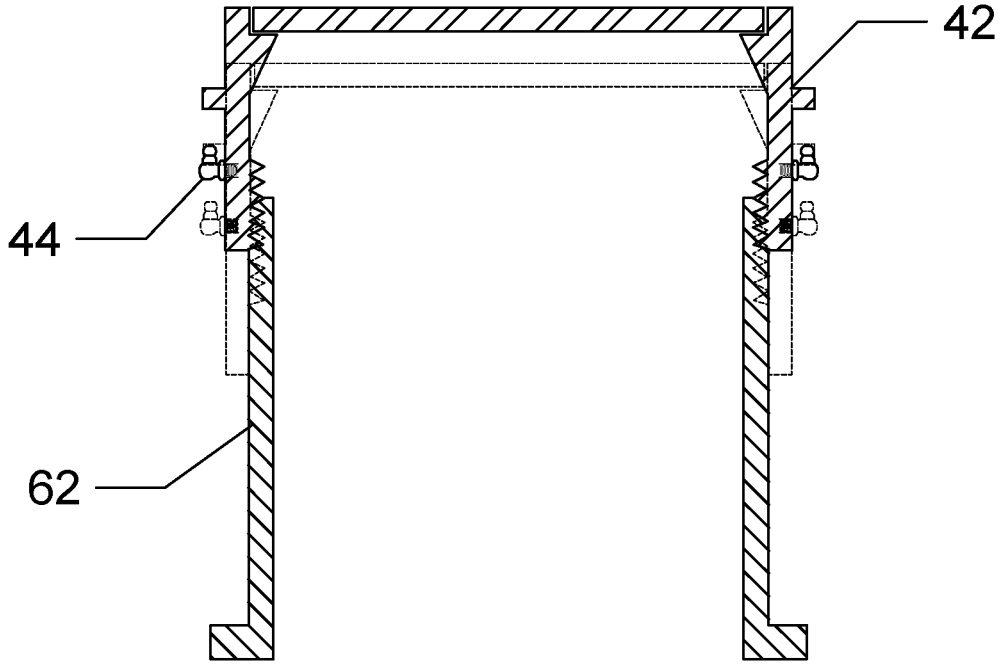
FIG. 4B is a representation of cross-sectional view of the present invention 10 when rises from the base by turning the female unit 42.

In an exemplary embodiment the manhole assembly 10 may be placed under the driving road surface and parallel to a base course 102, wherein the top surface of the lid is adjusted to be adjacent to a surface of a pavement 100 by a rotation of the female unit 42 by means of the interaction with the cleats 46. The female unit 42 rotates with respect to the male unit 62 as best observed in FIG. 4A. The rotation drives the female unit 42 to move upwards/downwards, along a vertical axis, with respect to the male unit 62 as shown and FIG. 4B. It is to be considered that in a suitable embodiment the grease fittings 44 may lubricate the threaded connection to help to reduce friction between the threaded section of the female unit 42 in contact with the threaded section of the male unit 62. A force may me exerted on the cleats 46, be it clockwise or counterclockwise, to adjust the height of the female unit 42 accordingly.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A height adjustable manhole cover, comprising:

a manhole cover assembly including a lid;

an outer assembly including a female unit wherein an bottom portion of the female unit is threaded, wherein said female unit supports on a top portion said lid, said female unit includes a plurality of cleats; and an inner assembly, wherein said inner assembly includes a male unit, wherein an top portion of the male unit is threaded, said top portion of said male unit is threadably connected with the bottom portion of said female unit, defining a threaded connection, when a force is exerted on said cleats the female unit rotates upwards or downwards with respect to said male unit, wherein said threaded connection is lubricated through at least one grease fitting.

2. The height adjustable manhole cover of claim 1, wherein said lid is adjacent to a surface of a driving road.

3. The height adjustable manhole cover of claim 1, wherein said inner unit is mounted on the surface of a concrete manhole unit by means of a flange.

4. The height adjustable manhole cover of claim 1, wherein said outer unit assembly is coupled to the inner unit assembly.

5. The height adjustable manhole cover of claim 3, wherein said female unit, by means of the threaded connection, is height adjustable.

6. The height adjustable manhole cover of claim 5, wherein said female unit rotates clockwise/counterclockwise.

7. The height adjustable manhole cover of claim 1, further includes a swivel joint disposed about a periphery of the male unit to prevent structural damages.

8. A height adjustable manhole cover, comprising:

a) manhole cover assembly including a lid having a top surface and a bottom surface wherein the top surface may be adjacent to a surface of the driving road;

b) an outer assembly including a female unit wherein an internal portion of a bottom portion of the female unit has a threaded section, wherein said female unit includes a groove disposed on a top portion thereof to support said lid, said female unit includes cleats attached about an external surface proximal to said top portion, said female unit further includes grease fittings;

c) an inner assembly, wherein said inner assembly includes a male unit, wherein an external section of a top portion of the male unit is threaded, said male unit and said female unit are coupled therebetween by means of the treaded portion of each the male unit and the female unit, defining a threaded connection, the inner assembly further includes a swivel joint internally disposed in said male unit to forestall structural damages; and d) when a force is exerted on said cleats the female unit rotates accordingly, be it clockwise or counterclockwise, thereby, and by means of the threaded connection, said female unit is adjusted in height with respect to the male unit, wherein said threaded connection is lubricated through at least one grease fitting.

9. A height adjustable manhole cover, consisting of:

a) manhole cover assembly including a lid having a top surface and a bottom surface wherein the top surface may be adjacent to a surface of the driving road;

b) an outer assembly including a female unit wherein an internal portion of a bottom portion of the female unit has a threaded section, wherein said female unit includes a groove disposed on a top portion thereof to support said lid, said female unit includes cleats attached about an external surface proximal to said top portion, said female unit further includes grease fittings;

c) an inner assembly, wherein said inner assembly includes a male unit, wherein an external section of a top portion of the male unit is threaded, said male unit and said female unit are coupled therebetween by means of the treaded portion of each the male unit and the female unit, defining a threaded connection, the inner assembly further includes a swivel joint internally disposed in said male unit to forestall structural damages, the male unit includes a flange formed at a bottommost end thereof that extends pass a periphery of the male unit; and d) when a force is exerted on said cleats the female unit rotates accordingly, be it clockwise or counterclockwise, thereby, and by means of the threaded connection, said female unit is adjusted in height with respect to the male unit, wherein said threaded connection is lubricated through at least one grease fitting.

* * * * *